United States Patent [19]

Andersen et al.

[11] Patent Number: 4,974,508

[45] Date of Patent: Dec. 4, 1990

[54] SCREEN PRINTING APPARATUS

[76] Inventors: Edward A. Andersen; Eric T. Andersen, both of P.O. Box 3787, Charlottesville, Va. 22903

[21] Appl. No.: 320,589

[22] Filed: Mar. 8, 1989

[51] Int. Cl.[5] ..... B41F 15/10

[52] U.S. Cl. ..... 101/115; 101/128.1

[58] Field of Search ..... 101/115, 126, 127.1, 101/128.1; 198/345

[56] References Cited

U.S. PATENT DOCUMENTS

| | | | |
|---|---|---|---|
| 3,427,964 | 2/1969 | Vasilantone | 101/115 |
| 3,596,704 | 8/1971 | Roe | 198/345 X |
| 4,099,460 | 7/1978 | Bubley et al. | 101/115 X |
| 4,669,378 | 6/1987 | Lee | 101/115 |

FOREIGN PATENT DOCUMENTS

| | | | |
|---|---|---|---|
| 306511 | 3/1930 | United Kingdom | 101/115 |

OTHER PUBLICATIONS

Artec Brochure, 12 pages, received by PTO 06/1985.

E-Z Register Textile Printers Brochure, 2 pages, received by PTO 06/1985.

*Primary Examiner*—Clifford D. Crowder

*Attorney, Agent, or Firm*—Staas & Halsey

[57] ABSTRACT

A multiple screen printing apparatus for multiple simultaneous printing in which the screen printing carrier head and the platen carrier head are indexed and locked together when the printing screens are down so as to provide precise registration. This indexing and locking arrangement resists degradation of the screen's registration during normal field use. Also, the apparatus has a precise microregistration adjustment system that permits adjustment of the printing screen attachment or screen clamping member relative to the screen carrier head by a controlled and guided adjustment movement in a single plane between a clamping plate and base member. This arrangement provides a coplanar locking so that no movement of the registration occurs during the clamping action.

24 Claims, 7 Drawing Sheets

FIG. 2
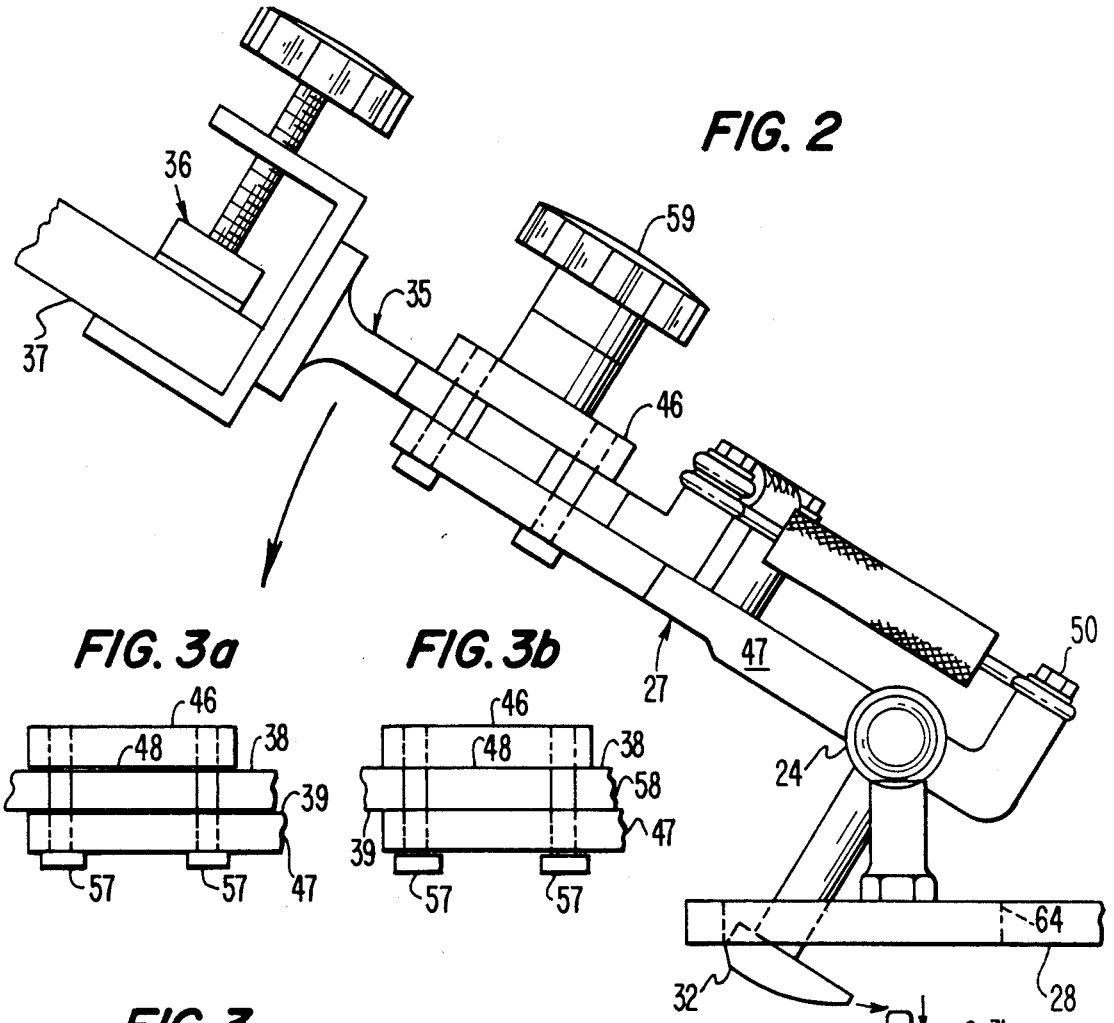
FIG. 3a
FIG. 3b
FIG. 3
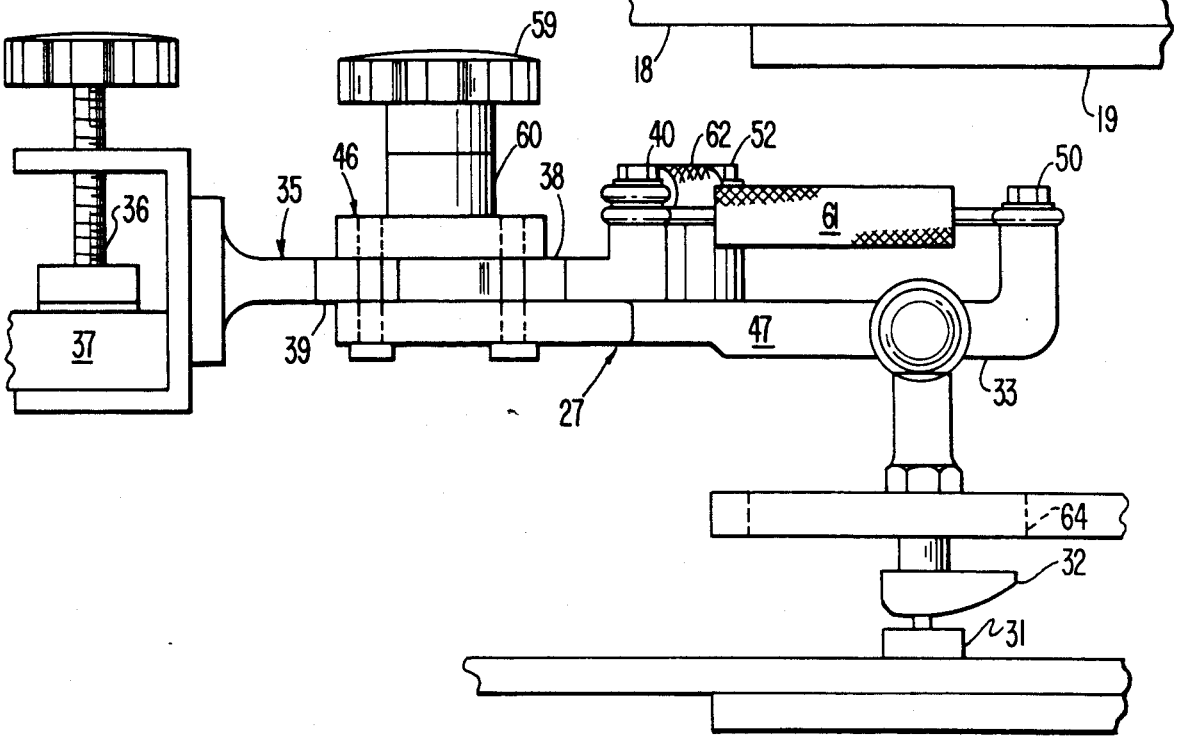

SCREEN PRINTING APPARATUS

This invention relates to screen printing equipment and especially (1) a screen registration assembly and (2) a screen printing apparatus whereby a plurality of screens rotate about a common point and may be simultaneously placed on a plurality of workpieces for screen printing.

Screen printing has become a big business and continues to grow with the technology being used on T-shirts, caps, sleeves bumper stickers and other workpieces where screen printing is appropriate. One type of screen printing apparatus is where a multiplicity of screens are rotated about a common point to be placed over a plurality of work holders. The screens are rotated while in an elevated or raised position and then when they are over a workpiece to be printed are lowered onto the work. A number of colors are frequently printed on the same workpiece and each color must be registered with the others to give a satisfactory product.

When only one screen is lowered at a time, registration with the workpiece is relatively easy. But if a multiplicity of screens are to be lowered at the same time, referred to as simultaneous printing or "all screens down" printing, registration at one work station may cause misregistration at a second work station because of imperfections in the equal spacing between the screens. Even if such spacing is set correctly at the factory, the machines will lose their initial settings in actual use.

Also, when a screen is initially mounted into a screen holder onto the machine, it must be brought into initial alignment by adjusting the screen holder. In the past, this has been done by moving the clamping arrangement, which is loosely held, and then when proper registration is achieved, tightening the clamping arrangement to prevent any further relative movement. However, because of the usual type of movement associated with the clamping arrangement, the action of clamping against further movement tends to disturb the registration initially achieved. One popular form of such a clamping arrangement is a U-shaped member that, as a practical matter, clamps along a line rather than over a wide surface.

The present invention improves the simultaneous printing apparatus so that as a practical matter all screen heads can be lowered and be acceptably registered for simultaneous printing and thus greatly increase the productivity of the machine. Although all heads can be used to print simultaneously with this invention, frequently only several heads are so used at one time but this is still a significant improvement over the normal apparatus.

A still further improvement made by this invention is the prior adjustment of the registration of this screen prior to beginning the printing operation. This is accomplished by a better adjustment apparatus. Instead of a U-type of screen clamping arrangement, the adjustment mechanism now involves a controlled and guided precision movement of the screen clamp carrier as a sandwich between two guiding planes which serve to guide the adjustment after the adjustment has been correctly made, it is clamped and locked into the position by planar surfaces to prevent the distortions and movements that have occurred in the past.

The above developments result in both a greatly improved apparatus for simultaneous screen printing and a greatly improved registration system for a simple, fast and accurate initial set up for multicolor printing.

In multicolor printing with proper registration, one color must be accurately indexed to the preceding color with the next color being accurately indexed to these two colors, etc., to get a proper acceptable multicolor product. The apparatus of the new invention has one plane containing the screen arms and another plane containing the print station, both rotating about a common axis.

In the past, a common method of indexing an individual print head to an individual print station was to have a screen arm with a steel tongue protruding from it on the order of ¼ inch wide by 3 inches long. This tongue would be received by a pair of radial ball bearings that would index this tongue precisely with respect to its print station so that the two rotating planes are locked together. This worked fine for an individual station but if multiple screens were to be used simultaneously they would have to be positioned so as to be equiangular spaced apart in a precise manner. For example, the equiangles are 90° in the case of a four station machine.

While the present tolerances required can be achieved at the factory, adjustments and abuse and wear in the field make it difficult to maintain this equiangular relationship which is essential before simultaneous and highly productive screen printing can take place. For example, if the indexing is ⅓ the distance from the axis of rotation and the screen printing actually occurs 3 times this distance from the axis, then there is a multiplier of any error in the indexing of three times. For example, if the indexing is off 0.004 inch (which is slightly more than the width of a human hair), then the misregistration would be 0.012 inch which is easily seen on a screen printed object. So even a quarter of a degree of a 360° circle is more than enough to give a misregistration.

Throughout this specification, a four station machine will primarily be described but it is to be understood that the quantity of stations can vary usually from two up to six or even higher. Usually, only 2 to 3 operators are used on an apparatus at the same time although, theoretically one operator could be assigned to each station. Even with two people printing simultaneously, the productivity doubles over a single person operating the apparatus.

The present invention has departed from the previous practice of indexing. There is no registration device on the screen arms themselves or on the platens and the steel bars going into roller bearings on each of the screen arms have been eliminated. It is believed that much of the wear takes place at this location to cause a degradation in the printing registration. The indexing and locking assembly of the present invention is located to lock the screen carrier head to the platen carrier head. The screen carrier head is a rotating member that carries the screen frames and is a one-piece member. Likewise, the platen carrier head is a rotating member that holds the platen supports or arms on which the platens are attached. Since these two carrier heads are one piece metal members, usually in the form of relatively flat aluminum plates, the precision location of the indexing provided at the factory is not substantially disturbed by actual field conditions so that the registration will not substantially degrade with use. Any movements of the platens or the screens such as by being replaced would not change the registration between the carrier heads themselves.

Further understanding of the advantages of the invention, together with additional features contributing thereto will be apparent from the following description of the invention when read in conjunction with the accompanying drawings wherein:

FIG. 2 is a partial side view of the apparatus showing the screen holder and adjustment mechanism and cam switch arrangement with the screen in the raised position and the switch not actuated;

FIG. 3 is a view similar to FIG. 2 but showing the screen in the down position and the switch actuated;

Figure 4:
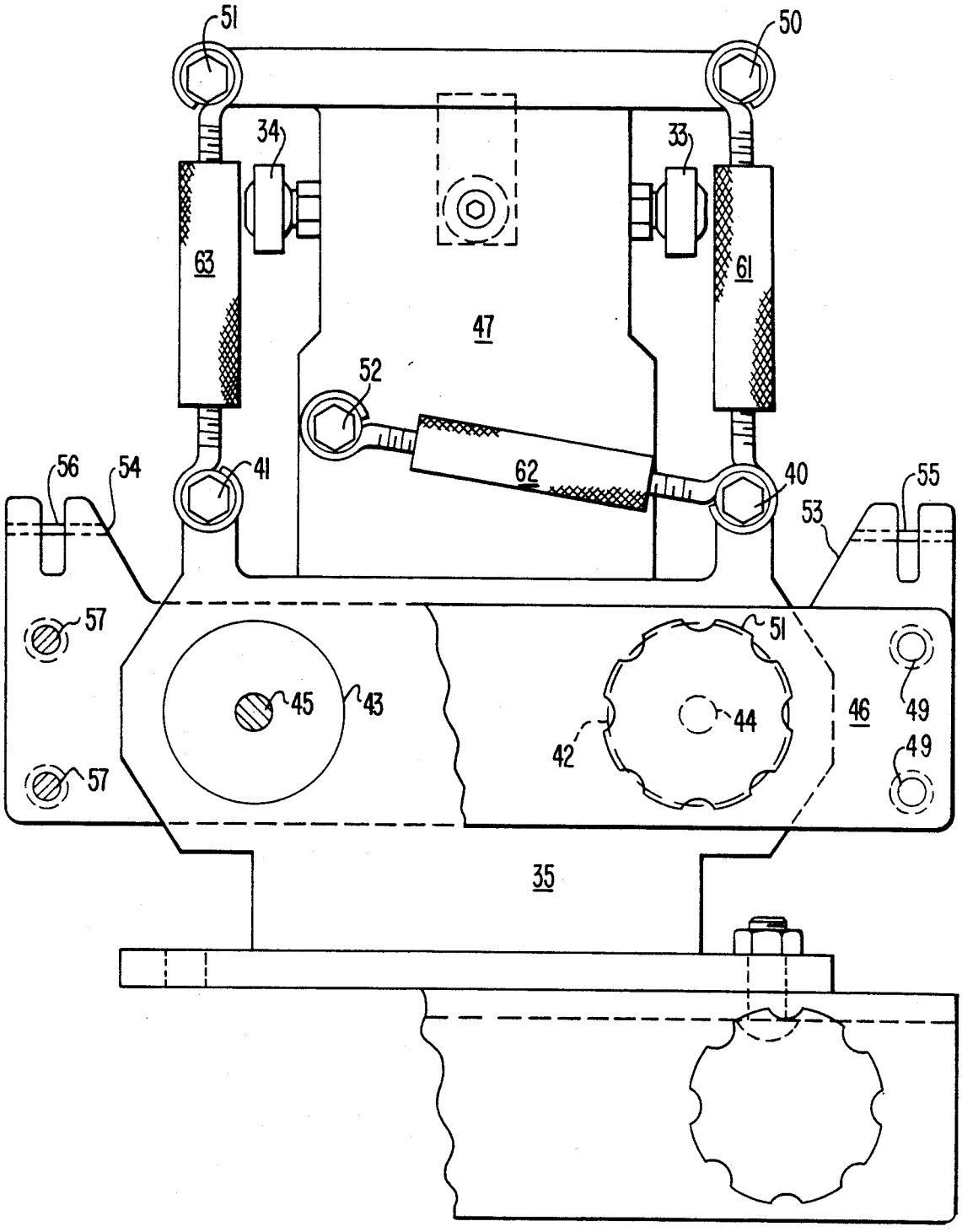
Figure 5:
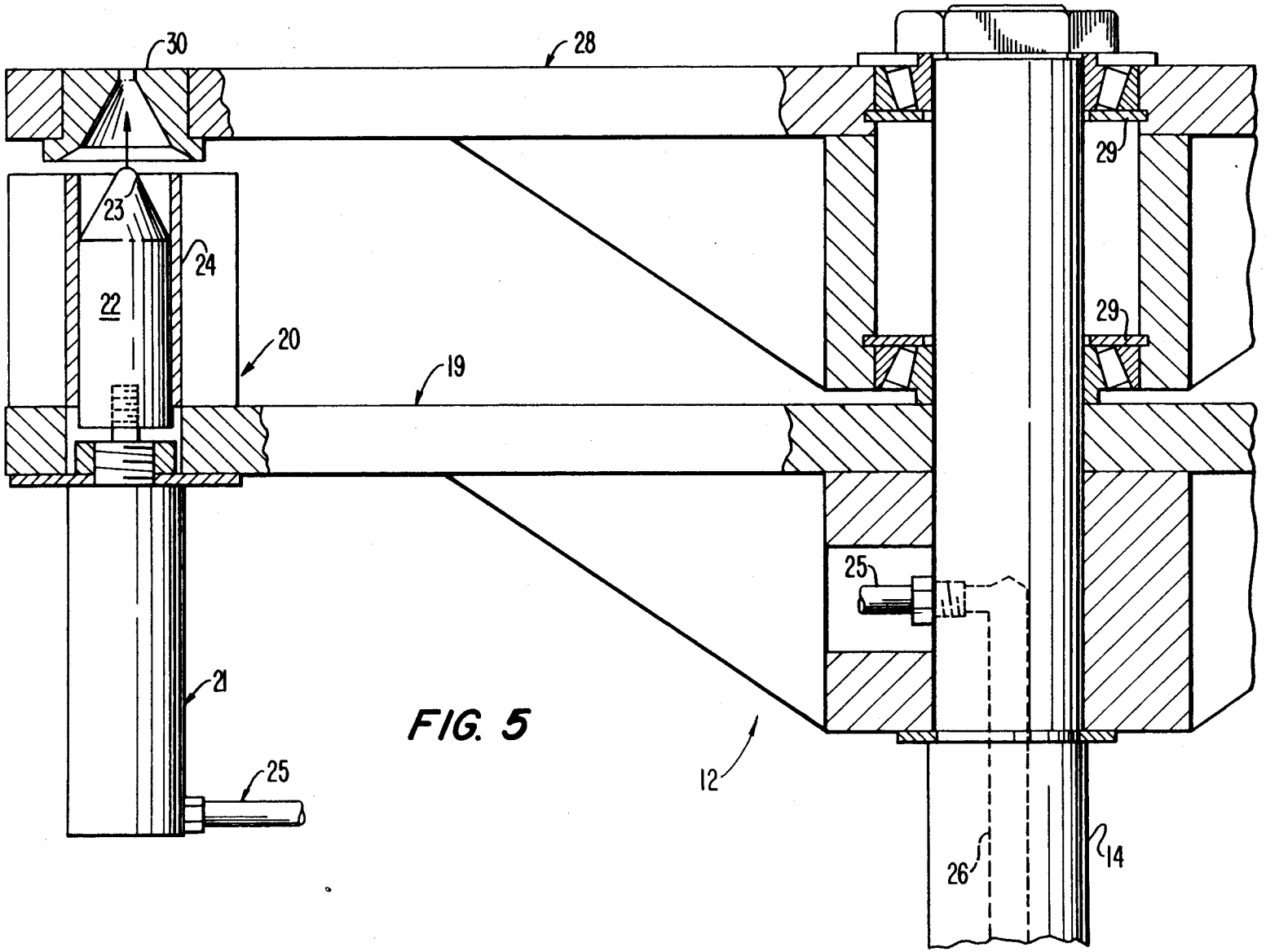
Figure 6:
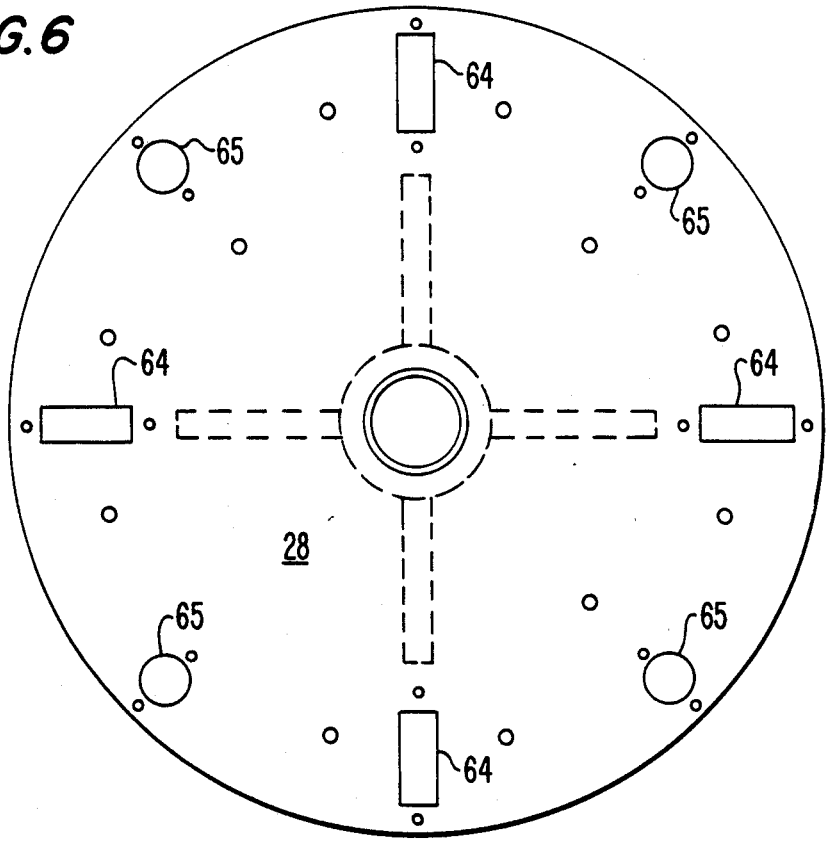
Figure 7:
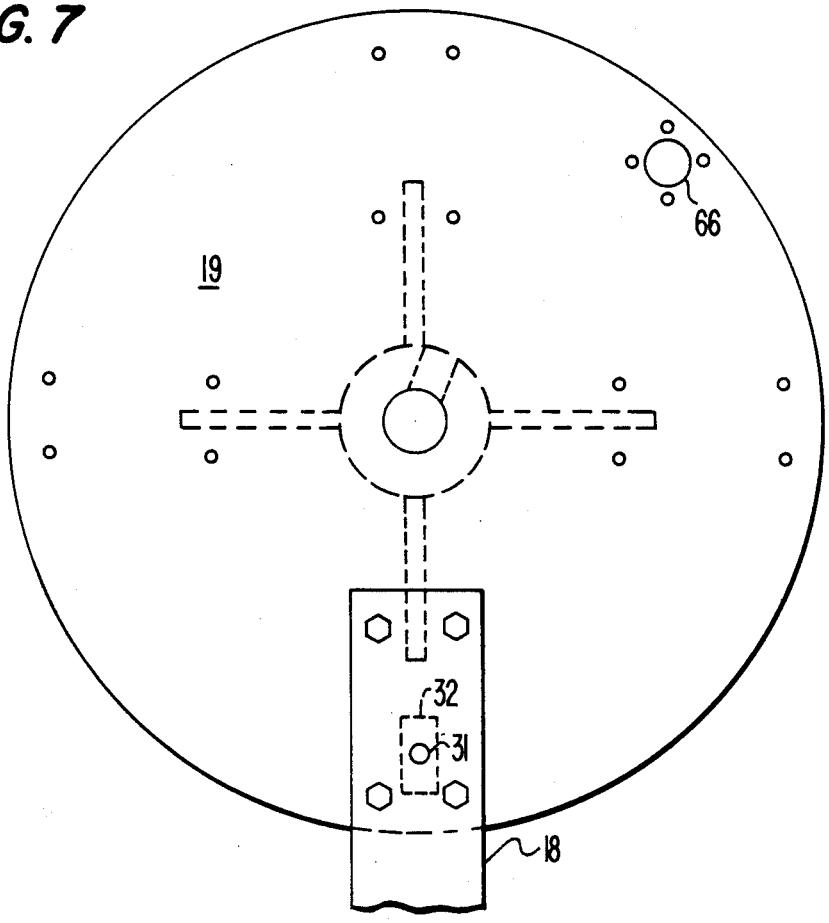
Figure 8:
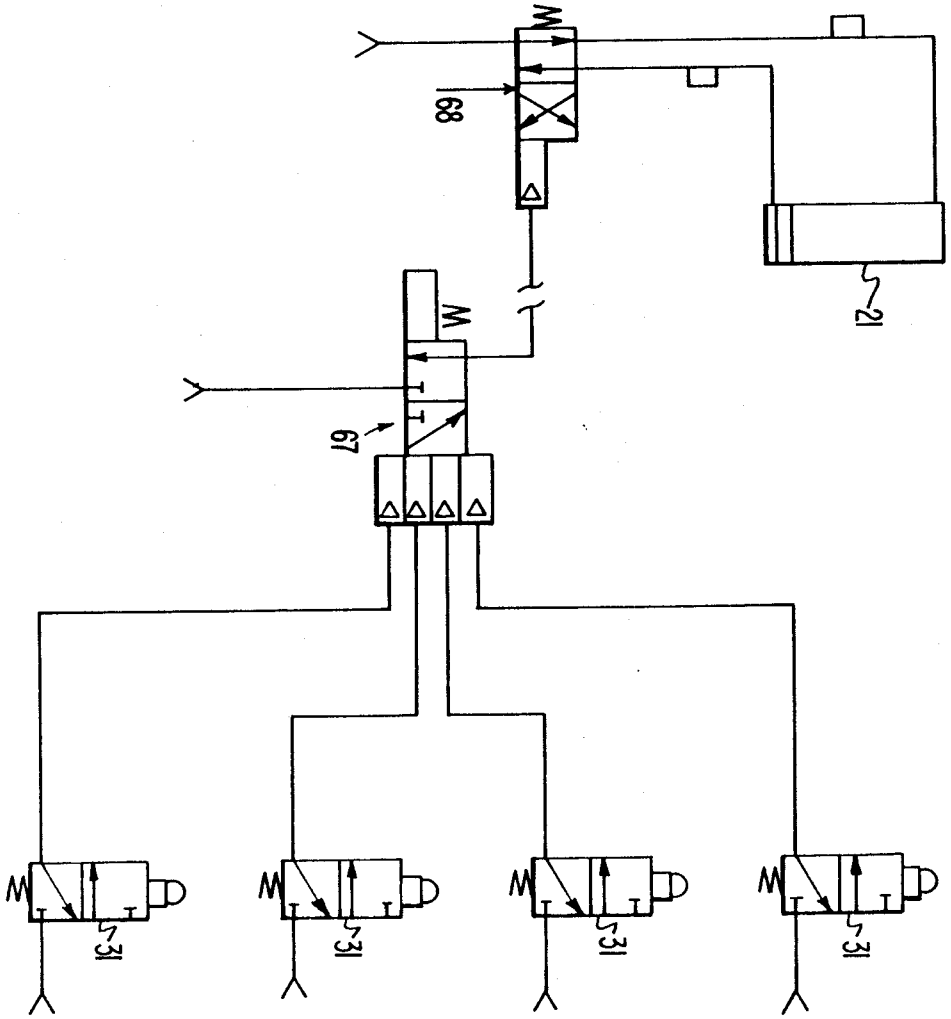
Figure 9:
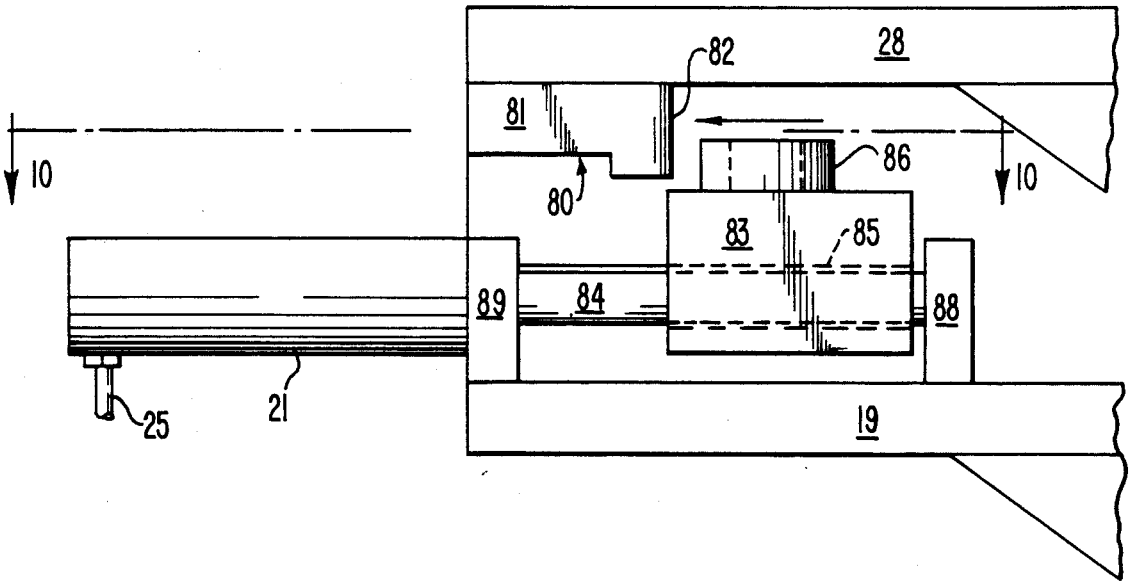
Figure 10:
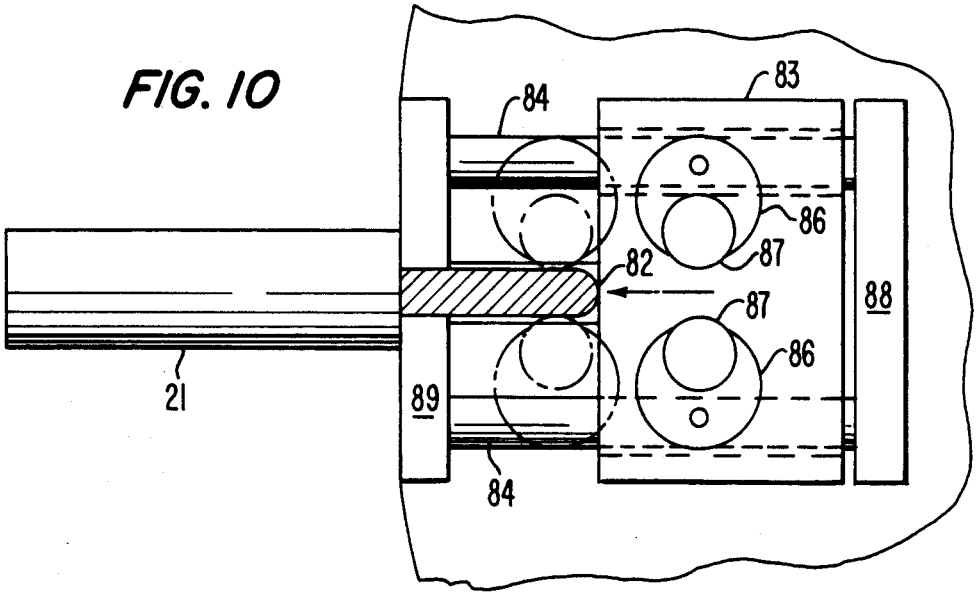

FIG. 3*a* is a partial side view showing the adjustment mechanism in the non-clamped position;

FIG. 3*b* is a view similar to FIG. 3*a* with the adjustment mechanism in a clamped position;

FIG. 4 is a plan view partially in section of the screen carrier including its adjustment mechanism;

FIG. 5 is a cross-sectional view of part of the apparatus showing the indexing and locking mechanism;

FIG. 6 is a plan view of the screen carrier head prior to the screen carrier and other components being attached thereto;

FIG. 7 is a plan view of the platen carrier head prior to most of the components being attached thereto;

FIG. 8 is a pneumatic circuit diagram of the circuit utilized to index the apparatus;

FIG. 9 is a broken away side view of a second and preferred embodiment of the indexing and locking mechanism;

FIG. 10 is a top view taken on Section 10—10 of FIG. 9; and

Figure 11:
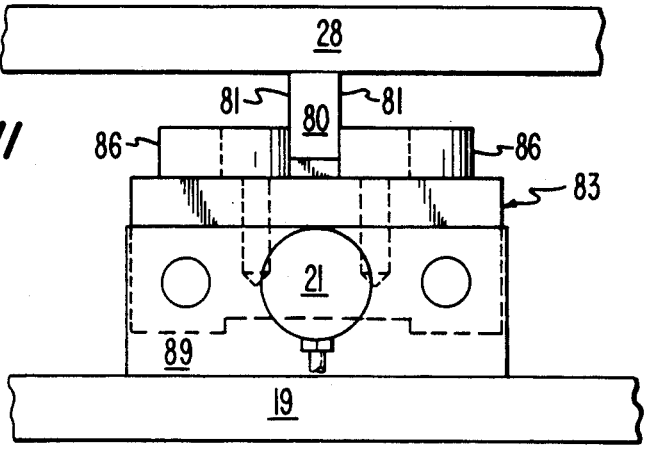

FIG. 11 is an end elevational view of FIGS. 9 and 10.

Figure 1:
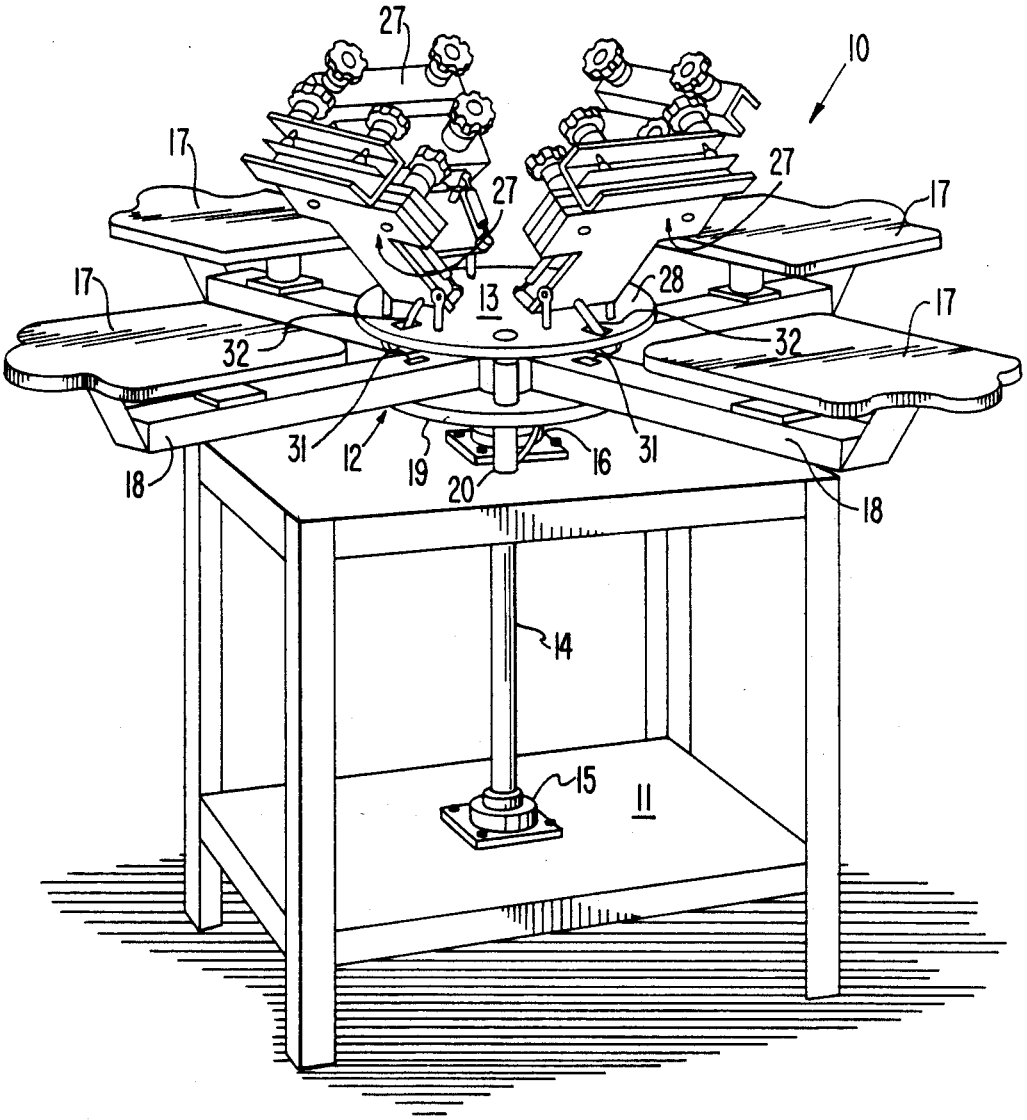
FIG. 1 is a perspective view of a standard four station screen printing apparatus.

With reference to FIG. 1, there is shown a multiple screen printing apparatus 10 having a mounting base 11, a platen carrying assembly 12 and a screen carrying assembly 13.

As seen in FIGS. 1 and 5, the platen carrying assembly 12 is attached to a vertical shaft 14 which rotates in a lower bearing 15 and an upper bearing 16 which are attached to the mounting base.

As used in this specification, "platen" is meant to be a variety of holders for various work which is to be printed. This work may be baseball caps, sleeves, T-shirts and other objects.

The four platens 17 shown in FIG. 1 are those designed for holding T-shirts. The platens 17 are attached to the outer end of platen support beams or arms 18. The platen support beams are fixedly mounted to platen carrier head 19.

Also mounted on platen carrier head 19 is an indexing and locking plunger 20, which is better seen in FIG. 5, that consists of a pneumatic motor 21 driving a plunger 22 having a conical end 23. The plunger 22 is located within guide sleeve 24. The pneumatic motor 21 is connected by pneumatic conduit 25 which runs from the motor to the vertical shaft 14. An internal pneumatic passageway 26 runs down the shaft 14 to a rotary air coupler and source of pneumatic pressure (not shown).

Also shown on FIG. 1 with the screen carrying assembly 13 are four screen attachment and registration assemblies 27, each of which is pivotally mounted on a screen carrier head 28. With reference to FIG. 5, the screen carrier head 28 can be seen as rotary mounted to vertical shaft 14 by bearings 29 and thus concentrically and coaxially rotates with platen carrying assembly 12 and platen carrier head 19.

An alternative is to have both platen carrier head 19 and screen carrier head 28 rotating independently about an axis such as shaft 14 rather than having the platen carrier head 19 fixed with regard to shaft 14. In this arrangement, it is essential that concentricity among all the components be obtained. When head 19 is fixed to shaft 14 then concentricity between heads 28 and 19 is not an absolute essential although such is desirable. In all situations, concentricity in equiangular spacing of the indexing and locking receiver cones or tongues must exist in screen carrier head 28.

Screen carrier head 28 has inserted therein an indexing and locking receiver 30 having a conical cavity complimentary to the conical end 23 of plunger 22. There is one indexing and locking receiver 30 for each screen attachment and registration assembly 27. When the screen carrier head 28 is rotated relative to platen carrier head 19 to the next work station or platen and the screen is lowered to print a workpiece such as a T-shirt, the plunger 22 is actuated to the upper position. This causes a final centering or indexing of the platen carrier head 19 to the screen carrier head 28 and locks the two in fixed angular position so that during the printing accurate registration is maintained.

This is a very important aspect to the invention and is the first time that a machine of this type has been able to achieve accurate positioning or indexing and locking of the stations so that all screens can print simultaneously by locking both the platen carrier head and the screen carrier head together by a direct arrangement between the two. Even though the indexing and locking is closer to the axis of rotation then normally the case, the arrangement permits an accurate positioning at the factory of the indexing and locking receivers and indexing and locking plunger which will not be disturbed by normal conditions of field use. Each screen printing station is indexed and locked with exact equiangular separation which in the case of four screens would be 90°, six screens would be 60° and so forth.

In addition to the male-female cone locking method shown in FIG. 5, a moving carriage mounted on the platen carrier head to engage an index tongue located on the screen carrier head as detailed in the next paragraph may be used as well as other alternatives so long as an accurate positioning or indexing and locking of the two carriers together is achieved so that the screens are spaced equiangular to one another.

An alternative and preferred embodiment of the indexing and locking arrangement is shown in FIGS. 9, 10 and 11. The figures show an indexing and locking receiver tongue 80 equiangularly spaced around the bottom surface of screen carrier head 28. The tongue is shown in FIG. 10 as having two parallel vertically extending planes 81 and a rounded entry 82. On the opposite platen carrier head 19 is shown the horizontally moving indexing and locking plunger arrangement in which a carriage 83 slides on parallel guide shafts or rails 84 with nylon bearings in the form of bushings 85 located in the carriage 83. On the top surface of the carriage is located two guides or bumpers 86. Located in each guide 86 is a metal cam roller bearing 87 with hardened surfaces. Such bearings are obtainable from many suppliers.

The guides or bumpers 86 are preferably made of a plastic such as nylon to absorb and dampen the impact and sound of the initial impact of the rounded entry 82 of tongue 80 when a pneumatic cylinder is actuated to move the carriage 83 and guide 86 to the left to cause the indexing and locking to take place. One of the guides 86 is fixed in position and the other guide 86 is adjusted in relation to the fixed guide and locked in position so the space between the roller bearings 87 is the distance between parallel planes 81.

The parallel rails or guide shafts 84 for the carriage 83 parallel the radius of the platen carrier head. The movement for indexing and locking is outward which is to the left in FIGS. 9 and 10. The return of the carriage to the right and unlocked position is buffered by an elastomeric buffering surface or pad (not shown) located to the immediate left of rail support 88. The guide shaft or rails are carried at their other and outer end by support 89.

The embodiment of FIGS. 9, 10 and 11 is an improvement over the cone arrangement since there is no pressure, which can be as much as 60 lbs., trying to push apart the two heads 19 and 28 and there is no requirement for tight radius tolerances. The equiangular spacing can be tightly controlled by the arrangement.

The roller bearings 87 inside the guides or bumpers 86 is a preferred arrangement but an alternate is to have two larger roller bearings 87 with the same diameter as the guides 86 which would give an equal size window for the insertion of rounded entry 82 of indexing and locking tongue 80. The two larger bearings would not have the dampening provided for by bumpers 86 which are preferably made of nylon.

With reference to FIG. 10, the position of the guides or bumpers 86 and roller bearings 87 are shown in their unlocked position by solid lines and in their actuated and indexed and locked position by the dotted lines. The dotted lines are to the left of the solid lines.

Also shown in FIG. 1 are pneumatic switches 31 which are actuated by switch actuators such as cam 32 attached to the underside of the screen attachment and registration assembly 27 so that when the screen is lowered to the printing position the actuator cam 32 is moved with it to actuate pneumatic switch 31. This is best seen in FIGS. 2 and 3. In FIG. 2, the screen is shown in the raised position with the cam 32 out of engagement or contact with switch 31. In FIG. 1, the screen is in the lowered position where cam 32 has been rotated downward and to the right to actuate switch 31. As will be seen later, when any of the pneumatic switches are actuated by a screen being down, the platen carrier head and screen carrier head are locked together so that they cannot move relative to one another.

With reference to FIGS. 2 through 4, there is shown the details of the screen attachment and registration assembly 27. The assembly 27 is pivotally mounted on the upper surface of the screen carrier head 28 at pivots 33 and 34 so that the printing screen can be raised and lowered about the pivot axis between pivots 33 and 34.

At the outboard end of screen attachment and registration assembly 27 is a screen attachment member 35 having an outer attachment end in the form of a clamp 36 for clamping the edge of printing screen 37 in a well known manner. The screen attachment member 35 has an upper planar surface 38 and a lower planar surface 39 both of which planes are smooth and lie parallel to one another so that the thickness between the two is constant. At the inner end of screen attachment member 35 are two uprights 40 and 41 which serve as attachment points for turnbuckle adjustment means.

Circular holes 42 and 43 are provided in the screen attachment member 35 so as to accommodate clamping screws 44 and 45.

The screen attachment member 35 is sandwiched between clamping plate 46 and base member 47. Clamping plate 46 is a rectangular plate having a lower smooth planar surface 48 and four threaded holes 49 located at each corner of the plate.

Base member 47 is attached near its inboard end to pivots 33 and 34 and at its most in board end has vertical risers 50 and 51 as attachment points for the turnbuckle adjustment means.

Base member 47 also has an intermediate riser 52 as a third attachment point for the turnbuckle adjustments.

At the outboard end of base member 47 there are two wings or extensions 53 and 54 which are the same width as clamping plate 46. The innermost ends of the extensions 53 and 54 have a spring receiving pins 55 and 56.

Coil springs (not shown) are attached at 55 and 56 and lead back to the screen carrier head where their other end is fastened. These coil springs serve to hold the screen attachment registration assembly 27 in the upward position when not printing but when the assemblies are lowered for printing the spring passes through the pivot point in an over-center action so that the screens are held in their down position while printing.

Also, located in extensions 53 and 54 are oversized bolt holes through which pass four capture bolts 57. These capture bolts are free to slide in the holes which are slightly oversized to accommodate them as will be explained more fully below.

Base member 47 also has a smooth planar surface 58 on the upper surface thereof over which the screen attachment member 35 is free to slide when not clamped down.

As is seen best in FIGS. 2 through 3, the screen attachment member is sandwiched between the clamping plate 46 and the base member 47 so that the upper smooth planar surface of base member 47 is in contact with the smooth lower planar surface 39 of the screen attachment member 35 and the lower smooth planar surface of clamping plate 46 is in contact with the upper smooth planar surface of screen attachment member 35. The assembly is held together by capture bolts 57 which have their lower end headed and their upper end threadedly received into the threaded holes 49 of base member 47. Since the capture bolts 57 have their shanks smooth and slidable in oversize hole located in the extensions 53 and 54 of the base member, the base member is free to slide on the capture bolts for a restricted distance determined by the length of the capture bolts above the bolt head.

A clamping arrangement is provided for the assembly by means of clamping screws 44 and 45 which are threadedly received into the base member 47 and are adapted to be loosened and tightened by two clamping knobs 59. The clamping screws 44 and 45 pass through oversized holes in the clamping plate 46 so that as the knobs 59 are tightened, they apply pressure to the ferrule spacer 60 which applies pressure to the clamping plate 46 to draw it closer to base member 47 and clamp screen attachment member 35 therebetween. The ferrule 60 has an inside hole that is larger than the diameter of the clamping screw 44 and 45 but has an outside diameter greater than the oversized hole in the clamping plate 46.

When the knob 59 are loosened and the clamping plate and base member are free to separate, they can separate only a small distance as shown in FIGS. 3*a* and 3*b*. In 3*b*, they are clamped tightly together holding the screen attachment member 35 therebetween so that the three members, i.e., base member clamping plate and screen attachment member are locked to one another. When the knob is loosened, the plates can separate but only to the extent permitted by the head 57 of the capture bolt which prevents any separation beyond approximately 0.015 of an inch and preferably only approximately 0.007 of an inch. This close spacing permits a controlled and guided adjusting movement of the base member relative to the screen attachment member which is confined to glide in a plane defined by the smooth planar surface of the base member below and the smooth planar surface of the clamping plate above.

The controlled and guided adjustment movement is made by three turnbuckle adjusters 61, 62 and 63. The turnbuckle adjusters have knurled adjustment cylinders arranged so that adjustment cylinders 61 and 63 are parallel to one another and are connected respectively between attachment points 50 and 40 and between attachment points 51 and 41 so that as they are adjusted in and out by turning the knurled cylinder they move screen attachment member in and out with respect to the base member. If only one adjuster is moved out, then a combined rotary movement and outward movement is achieved. If both adjustment cylinders 61 and 63 are turned to move the units out simultaneously, it moves only outward with no rotation around any adjustment attachment point.

Adjustment cylinder or turnbuckle 62 is attached at one end to attachment point 40 and at the other end attachment point 52 and serves to move the screen attachment member primarily in a transverse direction relative to the base member although there may be some minor movement in other directions depending on the positions of the other adjustment cylinders.

By using the three adjustment cylinders, the screen attachment member is rapidly adjusted to bring accurate registration to the printing screen. Since the movement is controlled and guided in a single plane by the parallel plane surfaces of the base member and clamping plate, when the clamping knobs 59 are tightened there is no distortion or movement away from the desired registration point. This is unlike previous devices that did not have the captured controlled and guided coplanar clamping arrangement as just described. One of the most popular previous devices utilized a U clamp where the metal is sprung into tight contact. This springing action resulted largely in merely line clamping which permits distortion away from the adjustment position during the clamping process.

With reference to FIGS. 2 and 3, there is seen actuator cam 32 is connected to the base member 47 and moves therewith. It extends through a slot 64 in the screen carrier head 28 so as to be able to contact and actuate the pneumatic switch 31. Slots 64 better seen in FIG. 6 which shows the screen carrier head without the attachments. In addition to the four slots 64, the screen carrier head 28 has mounting holes 65 for the indexing and locking receivers 30.

With reference to FIG. 7, there is shown the platen carrier head 19 without any of the attachments other than one platen support beam 18. The relative location of the pneumatic switch 31 and actuator cam 32 are also shown. Mounting holes 66 for the pneumatic motor 21 and indexing and locking plunger 20 precisely located on platen carrier head 19 so that when assembled the indexing and locking plunger is precisely located with respect to the indexing and locking receivers 30. It is to be noted that there is one indexing and locking receiver 30 for each of the screen attachment and registration assemblies 27 but there is preferably only one indexing and locking plunger 20. On some occasions a second plunger may also be used. It is to be noted that the plunger and the receivers are located near the periphery of their respective carrier heads.

With reference to FIG. 8, there is shown a pneumatic circuit for the apparatus for which normally an air source is available in most shops. This is normally called "shop air" and is usually about 60 p.s.i.g. There is shown the four pneumatic switches 31 which are normally closed three way poppet valve switches.

An operator frequently will not notice when he or she pulls the screen down that it may be somewhat misaligned but if the screen is anywhere near the correct position, the pneumatic switch will be operated and the piston cone or wedge or metal cam roller bearings of the indexing and locking plunger or carriage as it enters into a mating or complimentary receiver 30 or 80 will rotate the two carrier heads into their final and correctly indexed correct position.

While the indexing and locking plunger arrangement is preferably located on the bottom or platen carrier head, and the receivers located on the screen carrier or upper head, they could be reversed. What is important is that when the indexing takes place the two rotating carrier heads 19 and 28 are locked together precisely in the angularly correct positions when the screen is lowered it is in proper registration.

The four pneumatic switches 31 are connected to a source of supply air and when actuated, serve to actuate an assigned pilot valve associated with the three way valve having four pilot valves 67 which is also connected with the source of supply pressure. The three way valve 67 is connected with the four way valve with associated pilot valve 68 which supplies air to the double acting pneumatic cylinder or motor 21 to cause it to move upward to the indexing and locking position and downward back to the unlocked position. The pneumatic motor could also have a normally biased downward piston with an actuated raised piston position.

Although a pneumatic system is shown as most desirable, an electric or electropneumatic system could also be utilized.

In operation, if any of the actuating pneumatic switches 31 are actuated because one of the printing screens is in the down position, its associated pilot valve causes the three way valve 67 to take a position to actuate the pilot valve associated with four way valve 68 to move the pneumatic motor or piston 21 into the indexing and locked position. If all of the screens are raised, all of the pneumatic switches 31 would be closed and the three way valve 67 would return to its normal position and four way valve 68 would return to its normal position to cause the pneumatic motor or cylinder 21 to drive the plunger to the downward and unlocked position.

While the invention has been described with reference to a preferred embodiment it will be understood by those skilled in the art that various changes may be made and equivalents may be substituted for elements thereof without department from the scope of the invention. In addition, many modifications may be made to adapt a particular situation, material or component to the teachings of the invention without departing from the essential scope thereof. Therefore, it is intended that the invention not be limited to the particular embodiment disclosed but that the invention will include all embodiments falling within the scope of the appended claims.

What is claimed is:

1. A multiple screen printing apparatus for multiple simultaneous printing comprising:

a mounting base;

a platen carrying assembly rotatably mounted on said base for carrying multiple workpieces;

a screen carrying assembly mounted for rotation relative to said platen carrying assembly and adapted to carry a multiplicity of printing screen;

said platen carrying assembly including a central horizontally extending platen carrier head having a top surface;

a plurality of platen supports mounted on said platen carrier head at approximately equiangular spacing to one another and extending radially outward which are adapted to carry work supporting platens;

said screen carrying assembly including a central horizontally extending screen carrier head having a bottom surface facing said top surface of said platen carrier head;

a plurality of screen attachment and registration assemblies pivotally mounted on said screen carrier head at approximately equiangular spacing to one another and extending outwardly which are adapted to carry printing screens in both a raised position and a screen printing down position;

a two component indexing and locking assembly having one component mounted on said platen carrier head and the other component mounted on said screen carrier head;

one of said components being a multiplicity of indexing and locking receivers corresponding in number to the number of said screen attachment and registration assemblies and located at exact equiangular spacing to one another;

the other of said components being one and only one indexing and locking plunger adapted to be moved into and complement one of a said indexing and locking receivers to index and lock said platen carrier head and said screen carrier head into exact locked angular relationship;

each of said screen attachment and registration assemblies carries an actuator; said platen carrying assembly includes a component for actuating said index and locking plunger adapted to be actuated by said actuator when said screen attachment and registration assemblies are moved to their printing position;

adjusting components associated with said attachment and registration assembly for adjusting the registration of any printing screen carried thereby; and locking components for locking said adjusting means from further adjustment.

2. A multiple screen printing apparatus for multiple simultaneous printing comprising:

a mounting base;

a platen carrying assembly rotatably mounted on said base for carrying multiple workpieces;

a screen carrying assembly mounted for rotation relative to said platen carrying assembly and adapted to carry a multiplicity of printing screens;

said platen carrying assembly including a central horizontally extending platen carrier head having a top surface;

a plurality of platen supports mounted on said platen carrier head at approximately equiangular spacing to one another and extending radially outward which are adapted to carry work supporting platens;

said screen carrying assembly including a central horizontally extending screen carrier head having a bottom surface facing said top surface of said platen carrier head;

a plurality of screen attachment and registration assemblies pivotally mounted on said screen carrier head at approximately equiangular spacing to one another and extending outwardly which are adapted to carry printing screens in both a raised position and a screen printing down position;

a two component indexing and locking assembly having one component mounted on said platen carrier head and the other component mounted on said screen carrier head;

one of said components being a multiplicity of indexing and locking receivers corresponding in number to the number of said screen attachment and registration assemblies and located at exact equiangular spacing to one another;

the other of said components being one and only one indexing and locking plunger adapted to be moved into and complement one of said indexing and locking receivers to index and lock said platen carrier head and said screen carrier head into exact locked angular relationship;

each of said screen attachment and registration assemblies carries a switch actuator;

said platen carrying assembly includes a plurality of switches for actuating said index and locking plunger which are adapted to be actuated by said switch actuator when said screen attachment and registration assemblies are moved to their printing position;

adjusting components associated with said attachment and registration assembly for adjusting the registration of any printing screen carried thereby; and locking components for locking said adjusting means from further adjustments.

3. The screen printing apparatus of claim 2, wherein:

said screen carrier head has openings therein below each of said switch actuators; and said switch actuators being in the form of cams that protrude through said openings to actuate said switches when said screen attachment and registration assembly is moved to the screen printing position.

4. The screen printing apparatus of claim 3, which includes:

a control logic system which causes said index and locking plunger to be actuated when any one of said switches are actuated to cause said platen carrier head and said screen carrier head to be locked together when any one or more screen attachment and registration assemblies are in the lowered screen printing position.

5. The screen printing apparatus of claim 4, wherein said control logic system, said switches and said indexing and locking plunger are pneumatic.

6. The screen printing apparatus of claim 5, wherein said indexing and locking plunger includes a pneumatic motor; and a vertical shaft for carrying said platen carrying assembly and screen assembly having a pneumatic passageway therein connected to said pneumatic motor.

7. The screen printing apparatus of claim 6, wherein said mounting base includes an upper and lower bearing adapted to carry said vertical shaft; and said vertical shaft attached to said platen carrier head to physically rotate therewith.

8. The screen printing apparatus of claim 7, wherein said vertical shaft extends above said platen carrier head; and bearing means located on said vertical shaft extension adapted to carry said screen carrier head.

9. The screen printing apparatus of claim 2, wherein said screen carrier head and said platen carrier head are principally in the shape of flat metal discs.

10. The screen printing apparatus of claim 2, wherein said indexing and locking plunger includes a conical surface and said indexing and locking receivers include a conical cavity which is complementary to and mates with said conical surface for positioning and locking said screen carrier head and said platen carrier head together.

11. A screen attachment and registration assembly for use with screen printing apparatus comprising:

a base member having an outer end, an inner end and two sides;

a smooth planar clamping and guiding surface near said outer end of said base member;

a pivot near said inner end of said base member;

a screen attachment member having an inner end and an outer attachment end for attachment of printing screens thereto;

said screen attachment member having upper and lower smooth planar surfaces parallel to one another located inward from said outer attachment end thereof;

a clamping plate having a smooth planar clamping and guiding surface;

said upper and lower planar surfaces of said screen attachment member being sandwiched between said planar clamping and guiding surface of said clamping plate and said planar clamping and guiding surface of said base member;

capture means holding said base member and said clamping plate in association with one another but permitting them to move apart a distance only slightly greater than the thickness of said screen attachment member;

clamping force applying means for causing said base member clamping and guiding surface and said clamping plate clamping and guiding surface to be drawn together to clamp said planar surfaces of said screen attachment member therebetween and loosened to permit adjustment; and an adjustment means to move the position of said screen attachment member relative to said base member.

12. The screen attachment and registration assembly of claim 11, wherein said adjustment means includes two parallel and spaced apart turnbuckle adjusters that have one end attached near the inner end of said base member and attached at their other end near the inner end of said screen attachment member and a third turnbuckle adjuster attached near the inner end of said screen attachment member and attached to said base member near one of said sides thereof opposite the attachment location on said screen attachment member.

13. The screen attachment and registration assembly of claim 12, wherein said capture means permits the movement apart of said base member and said clamping plate the distance of no more than approximately 0.015 inches greater than the thickness of said screen attachment member.

14. The screen attachment and registration assembly of claim 13, wherein said distance is approximately 0.007 inches.

15. The screen attachment and registration assembly of claim 13, wherein said capture means includes a capture bolt having a head with the body of said capture bolt passing slidably through a hole in said base member which is smaller than said head and which is attached at the end opposite from said head to said clamping plate whereby when said clamping plate and base member move apart, the distance of said movement is limited by contact between said base member and said bolt head.

16. The screen attachment and registration assembly of claim 15, wherein said base member includes outer extensions on each side at said outer end which are approximately the same width as the length of said clamping plate and greater than the width of said screen attachment member with said capture bolts located in said extensions and near the end of said clamping plate.

17. The screen attachment and registration assembly of claim 16, wherein there are four capture bolts each located near a corner of said clamping plate.

18. The screen attachment and registration assembly of claim 17, wherein said clamping plate is located above said base member.

19. The screen attachment and registration assembly of claim 18, wherein said clamping force applying means includes a clamping screw threadedly received in said base member and slidingly received through an opening in said clamping plate with a clamping knob for rotating said clamping bolt adapted to be rotated in one direction to provide a clamping action and rotated in the opposite direction for unclamping.

20. The screen attachment and registration assembly of claim 19, wherein said clamping screw passes through a large hole in said screen attachment member with said hole being large enough to accommodate all adjustment movements of said screen attachment member.

21. The screen attachment and registration assembly of claim 20, wherein there are dual clamping bolts spaced apart along the width of said base member.

22. A multiple screen printing apparatus for multiple simultaneous printing comprising:

a mounting base;

a platen carrying assembly rotatably mounted on said base for carrying multiple workpieces;

a screen carrying assembly mounted for co-axial rotation with said platen carrying assembly and adapted to carry a multiplicity of printing screens;

said platen carrying assembly including a central horizontally extending platen carrier head having a top surface;

a plurality of platen supports mounted on said platen carrier head at approximately equiangular spacing to one another and extending radially outward which are adapted to carry work supporting platens;

said screen carrying assembly including a central horizontally extending screen carrier head having a bottom surface facing said top surface of said platen carrier head;

a plurality of screen attachment and registration assemblies pivotally mounted on said screen carrier head at approximately equiangular spacing to one another and extending outwardly which are adapted to carry printing screens in both a raised position and a screen printing down position;

a two component indexing and locking assembly having one component mounted on said platen carrier head and the other component mounted on said screen carrier head;

one of said components being a multiplicity of indexing and locking receivers corresponding in number to the number of said screen attachment and registration assemblies;

the other of said components being one and only one indexing and locking plunger adapted to be moved into and complement one of said indexing and locking receivers to index and lock said platen carrier head and said screen carrier head into locked angular relationship;

adjusting components associated with said attachment and registration assembly for adjusting the registration of any printing screen carried comprising:

a base member having an outer end, an inner end and two sides;

a smooth planar clamping and guiding surface near said outer end of said base member;

a pivot near said inner end of said base member;

a screen attachment member having an inner end and an outer attachment end for attachment of printing screens thereto;

said screen attachment member having upper and lower smooth planar surfaces parallel to one another located inward from said outer attachment end thereof;

a clamping plate having a smooth planar clamping and guiding surface;

said upper and lower planar surfaces of said screen attachment member being sandwiched between said planar clamping and guiding surface of said clamping plate and said planar clamping and guiding surface of said base member;

capture means holding said base member and said clamping plate in association with one another but permitting them to move apart a distance only slightly greater than the thickness of said screen attachment member between said upper and lower planar surfaces;

clamping force applying means for causing said base member clamping and guiding surface and said clamping plate clamping and guiding surface to be drawn together to clamp said planar surfaces of said screen attachment member therebetween and loosened to permit adjustment; and an adjustment means to move the position of said screen attachment means relative to said base member.

23. A multiple screen printing apparatus for multiple simultaneous printing comprising:

a mounting base;

a platen carrying assembly rotatably mounted on said base for carrying multiple workpieces;

a screen carrying assembly mounted for rotation relative to said platen carrying assembly and adapted to carry a multiplicity of printing screens;

said platen carrying assembly including a central horizontally extending platen carrier head having a top surface;

a plurality of platen supports mounted on said platen carrier head at approximately equiangular spacing to one another and extending radially outward which are adapted to carry work supporting platens;

said screen carrying assembly including a central horizontally extending screen carrier head having a bottom surface facing said top surface of said platen carrier head;

a plurality of screen attachment and registration assemblies pivotally mounted on said screen carrier head at approximately equiangular spacing to one another and extending outwardly which are adapted to carry printing screens in both a raised position and a screen printing down position;

a two component indexing and locking assembly having one component mounted on said platen carrier head and the other component mounted on said screen carrier head;

one of said components being a multiplicity of indexing and locking receivers corresponding in number to the number of said screen attachment and registration assemblies and located at exact equiangular spacing to one another;

the other of said components being one and only one indexing and locking plunger adapted to be moved into and complement one of said indexing and locking receivers to index and lock said platen carrier head and said screen carrier head into exact locked angular relationship;

said indexing and locking plunger includes a horizontally moving carriage carrying two spaced apart bearings;

said indexing and locking receivers includes tongues which are complementary to and mate with said spaced apart bearings for positioning and locking said screen carrier head and said platen carrier head together;

adjusting components associated with said attachment and registration assembly for adjusting the registration of any printing screen carried thereby; and locking components for locking said adjusting means from further adjustments.

24. A screen attachment and registration assembly for use with screen printing apparatus comprising:

a base member having an outer end, an inner end and two sides;

a smooth planar clamping and guiding surface near said outer end of said base member;

a pivot near said inner end of said base member;

a screen attachment member having an inner end and an outer attachment end for attachment of printing screens thereto;

said screen attachment member having upper and lower smooth planar surfaces parallel to one another located inward from said outer attachment end thereof;

a clamping plate having a smooth planar clamping and guiding surface;

said upper and lower planar surfaces of said screen attachment member being sandwiched between said planar clamping and guiding surface of said clamping plate and said planar clamping and guiding surface of said base member;

capture and clamping force mechanism for holding said base member and said clamping plate in association with one another but permitting them to move apart a distance only slightly greater than the thickness of said screen attachment member and for causing said base member clamping and guiding surface and said clamping plate clamping and guiding surface to be drawn together to clamp said planar surfaces of said screen attachment member therebetween and loosened to permit adjustment;

an adjustment means to move the position of said screen attachment member relative to said base member.

* * * * *

UNITED STATES PATENT AND TRADEMARK OFFICE

CERTIFICATE OF CORRECTION

PATENT NO. : 4,974,508

DATED : December 4, 1990

INVENTOR(S) : Edward A. Andersen et al

It is certified that error appears in the above-identified patent and that said Letters Patent is hereby corrected as shown below:

Title page, item [56] References Cited, under "OTHER PUBLICATIONS", line 1, "Artec" should read --Antec--.

Signed and Sealed this

Twenty-eighth Day of July, 1992

*Attest:*

DOUGLAS B. COMER

*Attesting Officer*

*Acting Commissioner of Patents and Trademarks*